US005735397A

United States Patent [19]

Cyr

[11] Patent Number: 5,735,397

[45] Date of Patent: Apr. 7, 1998

[54] LENS-GATE DIVIDER SYSTEM FOR CAMERA BAGS

[75] Inventor: Ryan Cyr, Hidden Hills, Calif.

[73] Assignee: Tamrac, Inc., Chatsworth, Calif.

[21] Appl. No.: 709,726

[22] Filed: Sep. 9, 1996

Related U.S. Application Data

[62] Division of Ser. No. 385,311, Feb. 7, 1995, Pat. No. 5,573,114.

[51] Int. Cl.[6] ..... B65D 85/38

[52] U.S. Cl. ..... 206/316.1; 206/316.2; 206/561

[58] Field of Search ..... 206/316.1, 316.2, 206/587; 190/109, 110; 220/523, 524, 526, 531, 532; 229/120.03, 120.07, 120.24, 120.26, 120.27

[56] References Cited

U.S. PATENT DOCUMENTS

| | | | |
|---|---|---|---|
| 1,415,776 | 5/1922 | Bourne . | |
| 1,478,202 | 12/1923 | Cadwell . | |
| 1,555,127 | 9/1925 | Lending . | |
| 1,661,728 | 3/1928 | La Rue | 220/524 |
| 2,665,801 | 1/1954 | Berkman . | |
| 2,691,401 | 10/1954 | Kontoff et al. . | |
| 2,907,363 | 10/1959 | Valette . | |
| 3,880,343 | 4/1975 | Rockefeller | 229/120.26 |
| 4,134,493 | 1/1979 | Cech | 206/485 |
| 4,301,942 | 11/1981 | Kupperman et al. | 220/532 |
| 4,498,580 | 2/1985 | Getz et al. | 206/485 |
| 4,610,286 | 9/1986 | Cyr . | |
| 4,928,819 | 5/1990 | Jakobsen . | |
| 5,131,542 | 7/1992 | Stenstrom | 206/485 |
| 5,356,004 | 10/1994 | Weinreb . | |
| 5,429,243 | 7/1995 | Woelk et al. | 229/120.26 |

FOREIGN PATENT DOCUMENTS

| | | |
|---|---|---|
| 580917 | 9/1992 | European Pat. Off. . |
| 968239 | 1/1958 | Germany . |
| 1155321 | 10/1963 | Germany . |
| 2061691 | 6/1972 | Germany . |
| 2910112 | 4/1980 | Germany . |

*Primary Examiner*—David T. Fidei

*Attorney, Agent, or Firm*—Thomas I. Rozsa; Tony D. Chen

[57] ABSTRACT

A lens-gate divider system for a camera bag. The gap or opening of the dividers is covered by swinging gates which can accommodate long camera lenses or camera bodies without the lenses attached thereto and also provide a plurality of different size compartments without the need to change to different dividers. In one embodiment, the lens-gate divider system comprises at least one lens-gate divider with two panels spaced apart and leaving a gap therebetween. Each panel has a swinging gate or door hingeably attached thereto and can swing open or closed in a lateral direction. In another embodiment, the system has at least one divider with a cut-out opening. A swinging lens-gate is hingeably attached to the divider to open or close the cut-out opening.

7 Claims, 5 Drawing Sheets

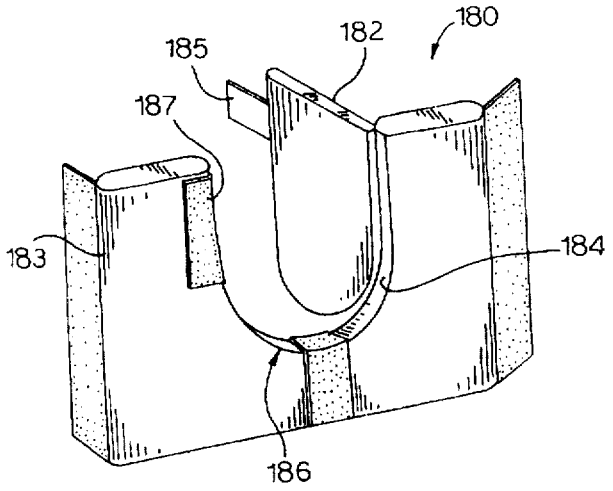
FIG.5
FIG.8
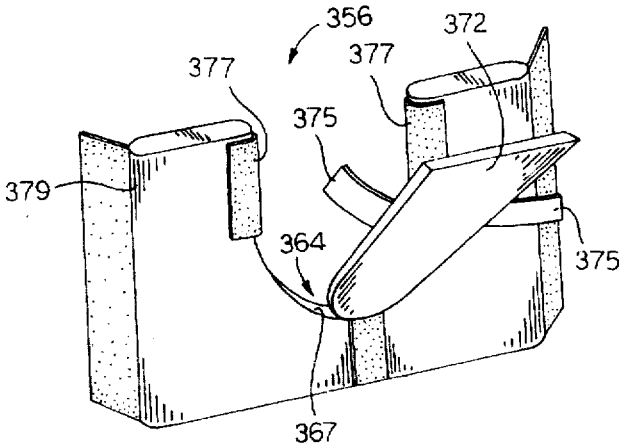
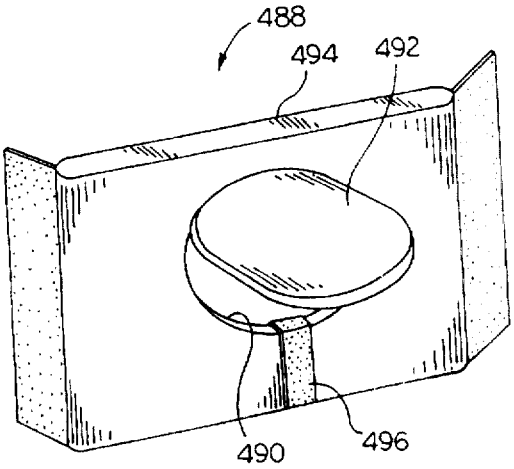
FIG.10
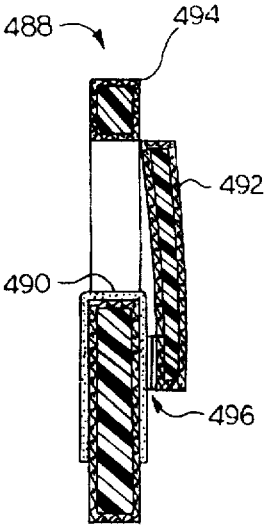
FIG.11

LENS-GATE DIVIDER SYSTEM FOR CAMERA BAGS

This application is a Divisional of the patent application Ser. No. 08/385,311 filed on Feb. 7, 1995, now U.S. Pat. No. 5,573,114.

BACKGROUND OF THE INVENTION

1. Field of the Invention

The present invention relates to the field of camera bags. More particularly, the present invention relates to dividers for partitioning the interior space of a camera bag into different sized compartments to store and carry equipment such as cameras, parts and accessories or other similar objects.

2. Description of the Prior Art

Professional and amateur photographers often store and carry many different photographic items for taking photographs in different circumstances. Cameras utilize interchangeable lenses, and many photographers want such lenses organized in a camera bag so that they are available for quick lens changing.

In many situations, two or more camera bodies may be carried in a camera bag, which the photographer may load with different films so that he or she can switch cameras as conditions change. For example, a sports photographer may carry two 35 mm camera bodies, loaded one with high speed black and white film for newspaper photographs and the other with color or slower film for magazine pictures. The photographer may need different telephoto lenses, a normal lens and wide angle lenses and may also carry one or more light meters, different types of flash attachments, filters and extenders.

In normal use, it is desirable to keep these items organized and protected. This organization may be crucial in certain situations where the photographer must change lenses rapidly without having to reach under unneeded items. It is also essential to provide sufficient protection to photographic equipment. Cameras are precision equipment that may be damaged by a sudden jolt. Lenses can be scratched and jarred out of alignment if not properly cared for.

When cameras are placed in a camera bag with a traditional U-shaped cutout portion of a divider supporting the lens which extends from the camera body, other camera accessories which are in the bag and adjacent the extending lens may scratch or dent the lens exterior or themselves be scratched or dented as the camera bag is carried. The user is forced to place newspaper, a rag or some other partition means between adjacent items in order to avoid this problem.

The following fifteen (15) prior art patents were uncovered in the pertinent field of the present invention:

1. U.S. Pat. No. 1,415,776 issued to Bourne on May 9, 1922 for "Film Holder" (hereafter "The Bourne Patent");

2. U.S. Pat. No. 1,478,202 issued to Cadwell on Dec. 18, 1923 for "Combination Hand Bag And Camera Carrying Case" (hereafter "the Cadwell Patent");

3. U.S. Pat. No. 1,555,127 issued to Lending on Sep. 29, 1925 for "Combined Hand Bag And Camera" (hereafter "the Lending Patent");

4. U.S. Pat. No. 2,665,801 issued to Berkman on Jan. 12, 1954 for "Combined Photograph Camera Carrying Case And Flashbulb Holder" (hereafter "the Berkman Patent");

5. U.S. Pat. No. 2,691,401 issued to Kontoff et al on Oct. 12, 1954 for "Expansible Carrying Case For Camera Parts Or The Like" (hereafter "the Kontoff Patent");

6. U.S. Pat. No. 2,907,363 issued to Valette on Oct. 6, 1959 for "Binocular Cases" (hereafter "the Valette Patent");

7. U.S. Pat. No. 4,610,286 issued to Cyr on Sep. 9, 1986 for "Camera Bag With Compensation For Variable Camera-Support Distance Below Lens, And With Improved Access" (hereafter "the Cyr Patent");

8. U.S. Pat. No. 4,928,819 issued to Jakobsen on May 29, 1990 for "Air Permeable Camera Case" (hereafter "the Jakobsen Patent");

9. U.S. Pat. No. 5,356,004 issued to Weinreb on Oct. 18, 1994 for "Camera Bag Divider System" (hereafter "the Weinreb Patent");

10. European Patent No. 580,917 for "Flexible Divider System For Camera Carrying Case" (hereafter "the '917 European Patent");

11. British Patent No. 1,066,021 issued to Doherty et al. on Apr. 19, 1967 for "Improvements In And Relating To Cases For Cameras And Like Articles Having A Projecting Hand Grip" (hereafter "the Doherty Patent");

12. German Patent No. 968,239 (hereafter "the '239 German Patent");

13. German Patent No. 1,155,321 (hereafter "the '321 German Patent");

14. German Patent No. 2,061,691 (hereafter "the '691 German Patent"); and

15. German Patent No. 2,910,112 (hereafter "the '112 German Patent").

The Bourne Patent discloses a film holder. It includes a case with a plurality of compartments adapted to receive film rolls.

The Cadwell Patent discloses a combination hand bag and a camera carrying case.

The Lending Patent discloses a combined hand bag and a camera carrier.

The Berkman Patent discloses a combined photograph camera carrying case and a flashbulb holder.

The Kontoff Patent discloses an expansible carrying case for camera parts. The carrying case includes an auxiliary pocket. Both the case and the pocket can expand into larger compartments.

The Valette Patent discloses binocular cases.

The Cyr Patent discloses dividers for a camera bag and having U-shaped cutouts that support a lens attached thereto and which extends out from the camera body. The divider supports various sized camera bodies with a telephoto or other lens attached.

The Jakobsen Patent discloses an air permeable camera case. The case has an air permeable resilient body and air permeable resilient end plates, which form the camera case.

The Weinreb Patent discloses a camera bag divider system. It includes a rigid divider and a self-opening divider means. The upper divider section of the self-opening divider can bend along configuration lines until they are in substantially horizontal positions. Basically, the bendable dividers are used for preventing items in the bottom compartments from striking the lens when the bag is turned on its side or upside down.

The '917 European Patent discloses the same flexible divider system as the Weinreb Patent.

The '021 British Patent discloses a case for a camera. It provides a hand grip which automatically closes when the camera is inserted into the case and which automatically opens upon the camera being withdrawn from the case.

The '239 German Patent, as disclosed from the figures shows a case.

The '321 German Patent, as disclosed from the figures shows a removable lens cover which can be attached to a camera case.

The '691 German Patent, as disclosed from the figures shows a cover for covering a video camera.

The '112 German Patent discloses a carrying case for a camera and accessories. It includes a central case body and four lids which completely or partially enclose the central case body and are fixed on the body so that they can be moved relative to the same and can be easily removed when required.

It is desirable to have a very efficient and also very effective design and construction of a lens-gate divider system which is not only functional in providing quick access to the camera body with attached lens, but also provides a self contained barrier means to partition the camera bag into selected compartments with the divider serving as a barrier to prevent adjacent items from coming in contact with each other.

SUMMARY OF THE INVENTION

The present invention is a lens-gate divider system for a camera bag. The concept of the present invention is to provide swinging gates or doors on dividers. By having swinging gates, it can accommodate long camera lenses, can provide a barrier between the lens and adjacent components and also provide a plurality of different size compartments without the need to change to different dividers. The number of compartments will change depending on the desired configuration and the size of the camera bag.

The present invention lens-gate divider system comprises at least one lens-gate divider. The at least one lens-gate divider comprises at least one swinging gate or door hingeably attached thereto and can swing open or closed in a lateral direction. The lens-gate divider is formed of a sandwich of an outer material which covers a central foam panel. This unique feature of the present invention allows the swinging gates on the lens-gate divider to open for accommodating a long camera lens and can also be configured to provide a plurality of different size compartments or it can be closed by using Velcro® fasteners to provide a full vertical length divider.

It is therefore an object of the present invention to provide a lens-gate divider system which comprises at least one lens-gate divider, where the lens-gate divider has at least one lateral swinging gate, so that the lateral swinging gate can be opened or closed in the horizontal direction to provide a plurality of different size compartments and also provide a full vertical length divider.

It is also an object of the present invention to provide a lens-gate divider system which comprises at least one lens-gate divider, where the lens-gate divider has at least one lateral swinging gate hingeably attached to a cutout portion at one end of the lens-gate divider, so that the lateral swinging gate can be opened or closed in the horizontal direction to provide a plurality of different size compartments and also provide a full vertical length divider.

It is an additional object of the present invention to provide a lens-gate divider system which comprises at least one lens-gate divider, where the lens-gate divider has at least one swinging gate hingeably attached to a cutout portion at one end of the lens-gate divider, so that the swinging gate can be opened vertically and also provide a horizontal protection. protection.

It is a further object of the present invention to provide a lens-gate divider system which comprises at least one lens-gate divider, where the lens-gate divider has a central opening therethrough for inserting a long camera lens and a vertical swinging gate hingeably attached at a side of the divider for covering the central opening when the long camera lens is not inserted therethrough.

In the preferred embodiment of the present invention, the lens-gate divider comprises a U-shaped cutout portion vertically located in the divider, where two lateral swinging gates are hingeably attached respectively within the U-shaped cutout portion, so that the swinging gates can be opened or closed laterally.

In another preferred embodiment of the present invention, the lens-gate divider comprises a U-shaped cutout portion centrally located in the divider, where only one lateral swinging gate is hingeably attached within the U-shaped cutout portion, so that the swinging gate can be opened or closed laterally.

In an additional embodiment of the present invention, the lens-gate divider comprises a square shaped cutout portion in the divider, where only one lateral swinging gate is hingeably attached within the square-shaped cutout portion, so that the swinging gate can be opened or closed laterally.

In another embodiment of the present invention, the lens-gate divider comprises a U-shaped cutout portion in the divider, where only one vertical swinging gate is hingeably attached within the U-shaped cutout portion, so that the swinging gate can be opened or closed in a vertical direction.

In still another embodiment of the present invention, the lens-gate divider comprises a square shaped cutout portion in the divider, where only one vertical swinging gate is hingeably attached within the square shaped cutout portion, so that the swinging gate can be opened or closed in a vertical direction.

In a further embodiment of the present invention, the lens-gate divider comprises a central opening, where a swinging door is hingeably attached to a side of the divider, so that the swinging door can cover the central opening and can also be opened or closed in a vertical direction.

In another embodiment of the present invention, the lens-gate divider comprises at least one vertical panel, where the panel has a lateral swinging gate hingeably attached to a longitudinal edge on the panel, so that the swinging gates can be opened or closed in a horizontal direction.

In another embodiment of the present invention, the lens-gate divider comprises at least one vertical panel, where the panel has two lateral swinging gates hingeably attached to a longitudinal edge on the panel, so that the swinging gates can be opened or closed in a horizontal direction.

The present invention lens-gate dividers can be vertical dividers that extend all the way to the bottom of the camera bag and swing in and out without having the U-shaped space. The swinging gates are essentially attached to a portion of the sidewall of the camera bag and can swing in either a horizontal direction or a vertical direction to create divisions in the camera bag so that different photographic equipment can be placed in the camera bag and separated from adjacent items so that they are not bumping or scratching each other as the camera bag is moved. The swinging gate can be attached to the wall by either having it as a one piece unit where the score is at the location where the gate swings, or it can be two separate units which are attached by means such as snaps or Velcro®, or it can be essentially one piece of fabric that is cut at the location of the swinging portion with the two pieces sewn together to provide the hinge means for the gate.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 5 is a perspective view of a further embodiment of the present invention lens-gate divider;

FIG. 8 is a perspective view of one of the lens-gate dividers which is shown in FIG. 7;

FIG. 10 is a perspective view of a further embodiment of the present invention lens-gate divider;

FIG. 11 is a cross-sectional view of the lens-gate divider which is shown in FIG. 10;

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

While the description will focus on a camera bag, it will be appreciated that the present invention can be utilized with any case comprising a base and sidewalls.

Figure 1:
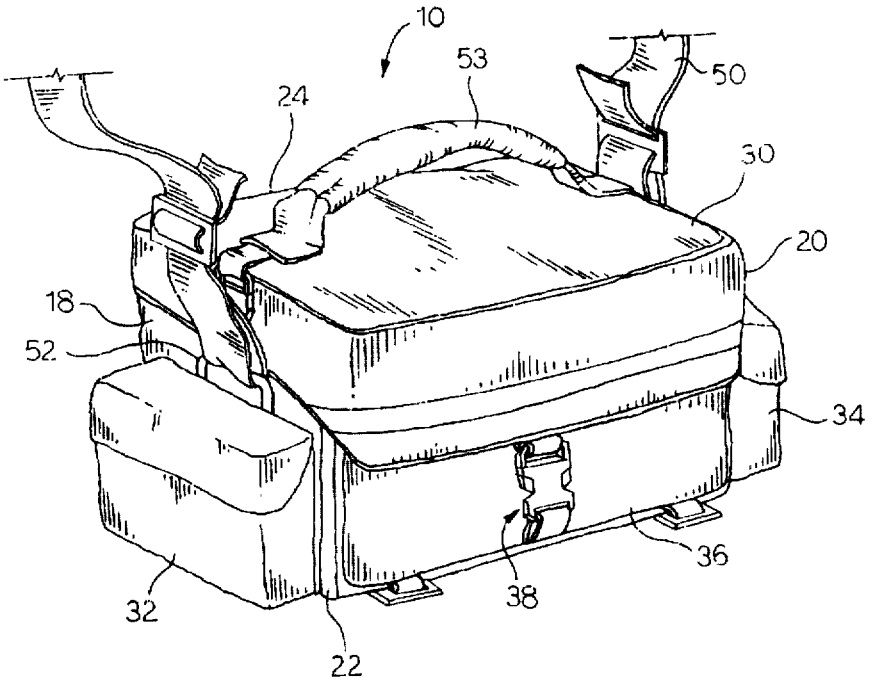
FIG. 1 is a perspective view of a camera bag with a cover in the closed position.
Figure 2:
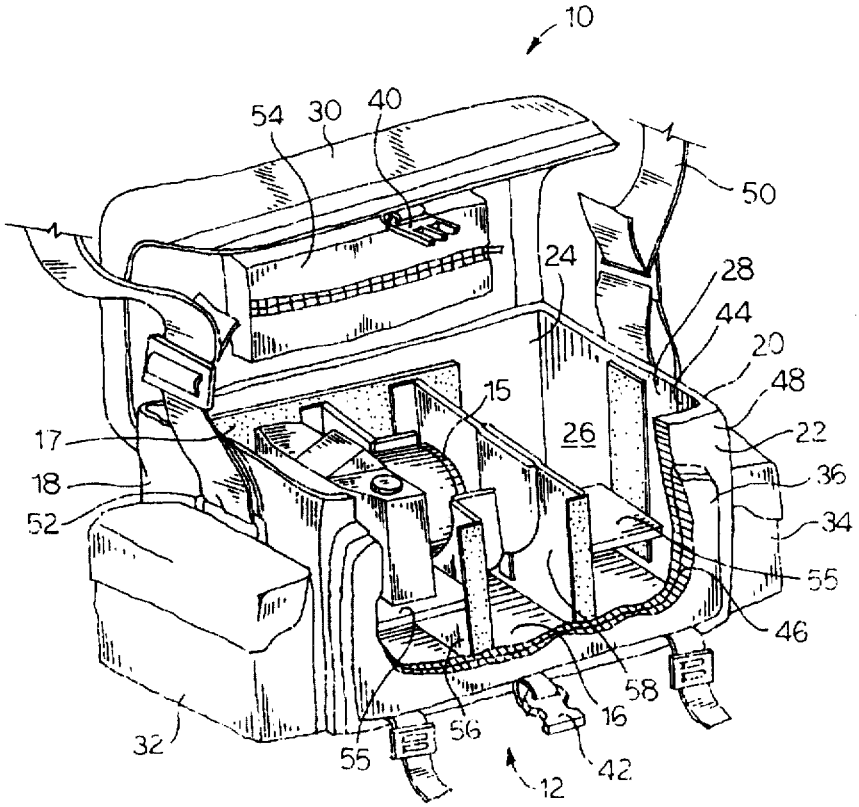
FIG. 2 is a partial cutout perspective view of the camera bad, illustrating a preferred embodiment of the present invention lens-gate divider system.

FIG. 1 illustrates a perspective view of a camera bag 110. FIG. 2 illustrates a partial cutout perspective view of the preferred embodiment of the present invention lens-gate divider system 12. Referring to FIGS. 1 and 2, the lens-gate divider system 12 may be used in the camera bag 10 for holding and storing a camera, film and photographic equipment. The camera bag 10 is generally a substantially rectangular shaped structure, but it may be a square, oval, round or any other shapes if desirable. The camera bag 10 includes a base wall 16, a pair of end walls 18 and 20, and a pair of sidewalls 22 and 24. The pair of end walls 18 and 20 are connected at their ends to the pair of sidewalls 22 and 24. The end walls 18 and 20 and the sidewalls 22 and 24 extend upwardly from the base wall 16 to form an enclosure 26 with a top opening 28. The sidewalls 22 and 24 are much wider than the end walls 18 and 20, but this may be modified if desirable. The camera bag 10 may have auxiliary pockets 32 and 34 attached on each end wall for storing certain types of articles, and there may also be a front auxiliary pocket 36 for storing other articles. The auxiliary pockets 32, 34 and 36 are fitted, in the usual manner, which is sewn on and which may be closed, for instance by Velcro® fasteners or zipper fasteners.

A top cover 30 is attached onto the rear upper edge of the sidewall 22 and adapted to be positioned to span and enclose the top opening 28 of the enclosure 26, thereby allowing the camera bag 10 to be opened and closed by a locking means 38 for restraining and protecting the photographic equipment. The locking means 38 includes a male clip type fastener 40 and a complementary female clip type fastener 42 for securing the cover 30 to the camera bag 10. It will be appreciated that the locking means 38 is not limited to the male and female clip type fasteners 40 and 42. The locking means 38 can also be snap-on type male and female fasteners or Velcro® type male and female fasteners.

The structure of the camera bag 10 is constructed of a multi-layer material which includes an inner layer 44, an intermediate layer 46 and an outer layer 48. The inner and outer layers 44 and 48 are preferably made of a Cordura® nylon material, a cotton duck material or any suitable material that can readily be sewn for convenience in manufacturing. The inner layer 44 should be generally smooth and resistant to moisture and dirt. The intermediate layer 46 is a foam plastic material. The material chosen must be rigid enough so that the camera bag 10 maintains its shape and yet flexible and shock absorbing to act as padding for protection of delicate photographic equipment. The outer layer 48 is a tough, tear resistant fabric, which is treated to make it water repellent.

A shoulder strap 50 is attached to the camera bag 10 by ring means 52 (only one is shown) on both ends of the camera bag 10. The ring means 52 are in turned attached to the outside of the respective end walls 18 and 20, so that the camera bag 10 can be carried on the shoulder of the user. An auxiliary handle 53 is also provided on top of the cover 30 to carry the camera bag 10 without utilizing the shoulder strap 50. The camera bag 10 is provided with a small pouch 54 which is attached to the inside of the cover 30 such that when the cover 30 is in the closed position, the small pouch 54 is enclosed within the enclosure 126 of the camera bag 10. The small pouch 54 may be closed by Velcro® fasteners or a zipper fastener.

Figure 3:
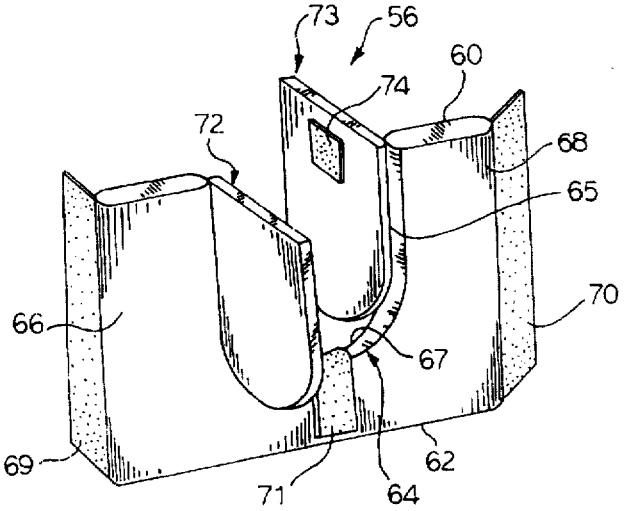
FIG. 3 is a perspective view of one of the lens-gate dividers which is shown in FIG. 2.
Figure 4:
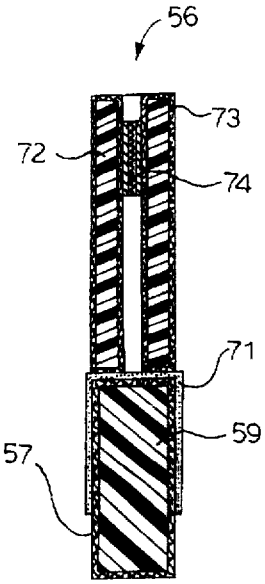
FIG. 4 is a cross-sectional view of the lens-gate divider which is shown in FIG. 3.

The preferred embodiments of the present invention lens-gate divider system are illustrated in FIGS. 3 through 5. FIG. 2 illustrates two spaced apart generally vertical and parallel lens-gate dividers 56 and 58. The key to the present invention is to have at least one such divider 56 or 58.

The lens-gate dividers 56 and 58 extend the entire distance between the sidewalls 22 and 24 of the enclosure 26 and are adjustably secured to the sidewalls. The dividers 56 and 58 are spaced from the end walls 18 and 20 of the enclosure 26 for dividing the camera bag 10 into at least three compartments. The number of compartments will change depending on the number of dividers used.

The lens-gate dividers 56 and 58 are preferably identical in construction, and only one will be described in detail. The divider 56 is formed of a sandwich of an outer layer 57 covering a central foam plastic panel 59. Normally, the outer layer 57 is formed as a pocket, the foam panel 59 is inserted into an opening left in the pocket, and then the opening is closed by sewing the last seam. The outer layer 57 is the same material used for the inner layer of the camera bag for the same reasons the material is used in those applications, and the foam panel 59 is also the same that is used in the end walls, the sidewalls and the bottom wall of the camera bag.

The lens-gate divider 56 has a top end 60 and a bottom end 62. The top end 60 has a U-shaped cutout portion 64 for loosely receiving and supporting a protruding lens 15 while the lens 15 is attached to the camera body, as shown in FIG. 2. The U-shaped cutout portion 64 is between two opposite lateral supports 66 and 68. The U-shaped cutout portion 64 has two inner opposite vertical edges 65 and an inner curved edge 67 which merges with the two opposite vertical edges 65 to form a harmonious continuous surface. The cutout portion 64 should have dimensions to accommodate the diameter of the largest lenses that the user is expected to carry attached to the camera body. The lateral supports 66 and 68 of the divider 56 are not too rigid, so that they can spread apart somewhat to accommodate wider diameter lenses. The lateral supports 66 and 68 of the cutout portion 64 prevent lenses from horizontal movement, and they also support the lens vertically.

The divider 56 is secured to the sidewalls 22 and 24 by adjustable securing means on the sidewalls and on the divider for adjusting the location of the divider to change the size of the compartments. Two elongated opposite vertical strips 69 and 70 are attached by attachment means along the seam of the vertical edges of the divider 56. The attachment means can be any means such as sewing, snaps, hook and loop Velcro® attachments etc. The vertical strips 69 and 70 have a Velcro® surface consisting of the hook portion, although a wide variety of holding means may be provided. An additional Velcro® strip 71 extends vertically upward at the center of the divider 56. The Velcro® surface of the strip 71 can either be the hook or loop type, depending on the situation.

Two elongated wide opposite strips 17 (only one is shown in FIG. 2) extend along generally the entire length of the sidewalls 22 and 24 of the camera bag 10. These wide strips 17 have the complimentary Velcro® loop pile that is gripped by the Velcro® hooks on the vertical strips 69 and 70. By positioning the vertical strips 69 and 70 along the corresponding wide strips 17, the positions of the dividers can be changed, and the size of the compartment is modified. The wide strips 17 may be attached by adhesives to the interior sidewalls of the camera bag, but is preferred to sew the wide strips 17 to the interior of the sidewalls.

Two lateral swinging gates or doors 72 and 73 are shaped similar to the U-shaped cutout portion 64, but are slightly smaller than the U-shaped cutout portion 64, so that they can swing in a horizontal direction with no difficulty. The swinging gates 72 and 73 are hingeably attached respectively adjacent to or to the vertical edges 65 of the U-shaped cutout portion 64 such that they are moveable between an open position, as shown in FIG. 3, and a closed position, as shown in FIG. 4. The hingeable attachment can be any hingeable attachment means. By way of example, each respective gate 72 and 73 can be sewn at one edge to respective vertical edge 65 of the U-shaped cutout. Alternatively, the hingeable attachment can be by hook and loop attachment or snaps or any other suitable means which permit the gate to swing. Each gate 72 and 72 is capable of remaining in the closed position by a press fit within the U-shaped cutout. As an additional security means, each gate may contain closure means. The means can be Velcro® fastener tabs 74 which are attached to the swinging gates 72 and 73 by conventional means, and are facing each other. When the swinging gates 72 and 73 are in the closed position, the divider 56 assembles into a full length divider. The swinging gates 72 and 73 are formed in the same manner as the divider 56, and the description thereof will not be repeated.

When the protruding lens of the camera body is received and supported in the U-shaped cutout portion 64, the two swinging gates 72 and 73 are positioned in the opened position such that the gates are protecting the sides of the protruding lens, as shown in FIG. 2. This is a key to the present invention. In the opened position, the gates 72 and 73 provide a barrier between the lens 15 and adjacent portions of the camera bag so that additional photographic equipment can be stored to one side of gate 72 and to the opposite side of gate 73. For example, a long telephoto lens can be positioned vertically in one adjacent compartment and a battery pack can be positioned in the opposite compartment. Each swinging gate 72 and 73 thereby provides a protective barrier between lens 15 and the other components such as a separate vertically positioned lens and at a battery pack in adjacent compartments. In this way, as the camera bag is moved, the gates 72 and 73 provide a secure barrier to thereby prevent components in adjacent compartments from coming in contact with one another and bumping or scratching one another. In the illustrations the gates 72 and 73 are shown as each being the same shape as the cutout and therefore overlapping. It will be appreciated that the gates 72 and 73 could also be a one-half U-shaped and therefore come together at the vertical center of the U, in a manner comparable to the doors of a bar. When the protruding lens is not attached to the camera body, the two swinging gates 72 and 73 can be positioned in the closed position to form the full length divider for protecting the camera body and other photographic equipment.

The present invention has many advantageous features including: (a) the swinging doors can be open to provide a cushioning barrier for the protruding lens; (b) the swinging doors are also protecting the sides of the protruding lens from damage; and (c) the swinging doors can be closed to form a full length divider.

The concept of the swinging gate for the U-shaped barrier can also include having only one gate rather than the pair of swinging gates. Referring to FIG. 5, there is shown a perspective view of this embodiment of the present invention lens-gate divider 180. In this embodiment, only one lateral swinging door 182 is utilized. The swinging door 182 is hingeably attached to one of the vertical edges 184 of the U-shaped cutout portion 186 by hingeable attachment means as previously described. The swinging gate or door 182 can remain closed by a press fit engagement within the U-shaped cutout portion 186. Alternatively, for additional security, the swinging door 182 can be maintained closed by a male fastener 185 and a complementary female fastener 187. The male fastener 185 is attached to an edge of the swinging door 182, while the complementary female fastener 187 is attached to one of the two lateral supports 183. The male and female fasteners 185 and 187 are interchangeable such that the male fastener 185 can be attached to one of the two lateral supports 183, while the female fastener can be attached to the edge of the swinging door 182. All of the other components are exactly the same as illustrated in FIGS. 2 through 4, and therefore description thereof will not be repeated.

Figure 6:
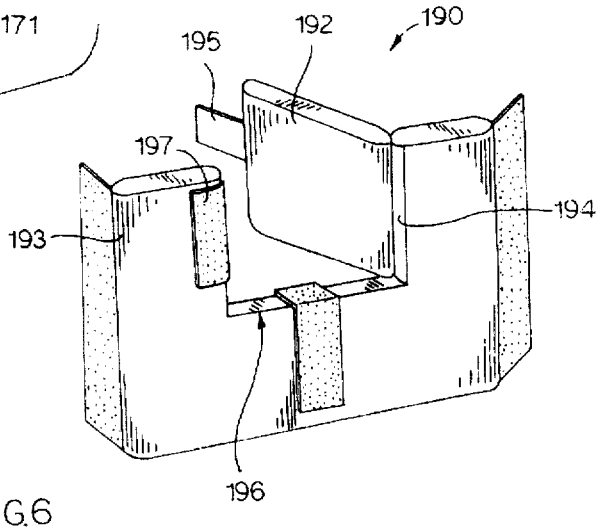
FIG. 6 is a perspective view of an additional embodiment of the present invention lens-gate divider.

While the cutout portion has been illustrated as a U-shaped cutout, it will be appreciated that the present invention is not limited to a U-shaped cutout configuration and the present invention lens-gate divider system can be utilized with any shape cutout such as oval, square, rectangular etc. By way of example, a generally square shaped cutout portion 196 is illustrated in FIG. 6. Also, while only one swinging door or gate 197 is illustrated, it will be appreciated that the pair of swinging gates, comparable to that illustrated in FIG. 3, or half gates which meet in the middle like bar doors, can be utilized with the alternative cutout shape. Referring to FIG. 6, there is shown a perspective view of this embodiment of the present invention lens-gate divider 190. In this embodiment, only one lateral swinging door 192 is utilized. The swinging door 192 is hingeably attached to one of the vertical edges 194 of a square shaped cutout portion 196. The swinging door 192 can be closed by a press fit into the cutout, or for additional closure power, can be closed by a male fastener 195 and a complementary female fastener 197. The male fastener 195 is attached to an edge of the swinging door 192, while the complementary female fastener 197 is attached to one of the two lateral supports 193. The male and female fasteners 195 and 197 are interchangeable such that the male fastener 195 can be attached to one of the two lateral supports 189, while the female fastener can be attached to the edge of the swinging door 192. All of the other components are exactly the same as illustrated in FIGS. 2 through 4, and therefore description thereof will not be repeated.

Up to this point, all of the gates as illustrated and described have generally vertically hingeable attachment means so that the gates swing in the horizontal direction to thereby provide vertically oriented cushioning surfaces and to vertically compartmentalize the camera bag. It will be appreciated that the present invention lens-gate divider system can also operate with the gates hingeably attached with a horizontal hingeable attachment means so that the gates swing in the vertical direction to thereby provide horizontally oriented cushioning surfaces and to horizontally compartmentalize the camera bag. The alternative orientation and alternative embodiments thereof are illustrated in FIGS. 7 through 10.

Figure 7:
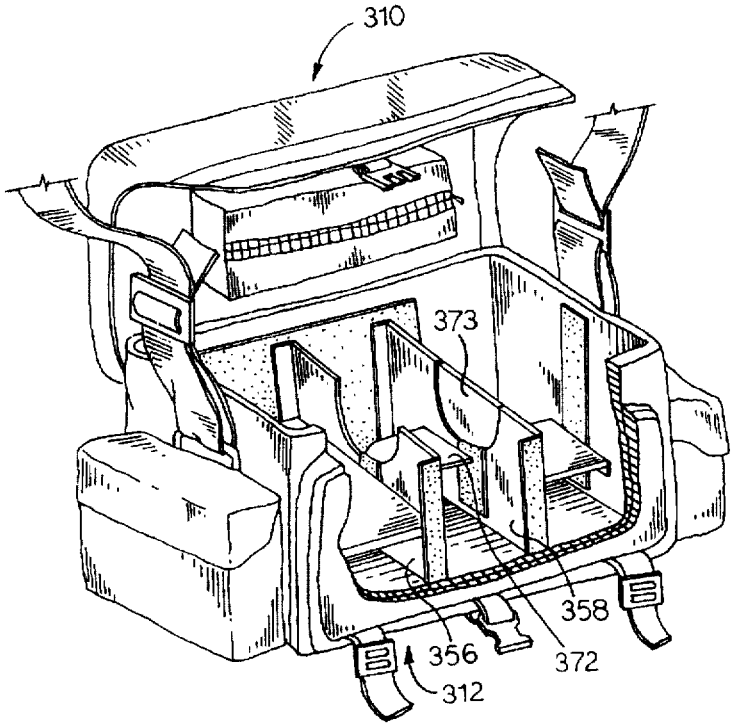
FIG. 7 is a partial cutout perspective view of the camera bag, illustrating another embodiment of the present invention lens-gate divider system.

Referring to FIG. 7, there is illustrated a perspective view of an alternative embodiment of the present invention lens-gate system 312 which is utilized in a camera bag 310. All of the parts are numbered correspondingly with 300 added to each number. In this embodiment, there is shown one of the swinging doors 372 of the divider 356 in the opened position, and the other swinging door 373 of the other divider 358 in the closed position.

Referring to FIG. 8, there is shown only one lens-gate divider 356 which is the embodiment shown in FIG. 7. The lens-gate divider 356 assembles and functions the same as previously described in FIGS. 2 through 4 except that the swinging gate 372 of the vertical upright lens-gate divider 356 is hingeably attached to the curved edge 367 of the U-shaped cutout portion 364, and therefore the description thereof will not be repeated. The swinging door 372 can be closed by a press fit of door 372 into the U-shaped cutout 364. For additional closure power, two male fasteners 375 and two complementary female fasteners 377 can be incorporated into the design. The male fasteners 375 are attached to opposite edges of the swinging gate 372, while the complementary female fasteners 377 are attached to the two lateral supports 379 respectively. The male and female fasteners 375 and 377 are interchangeable such that the male fasteners 375 can be attached to the two lateral supports 379, while the female fastener can be attached to the opposite edges of the swinging gate 372.

Figure 9:
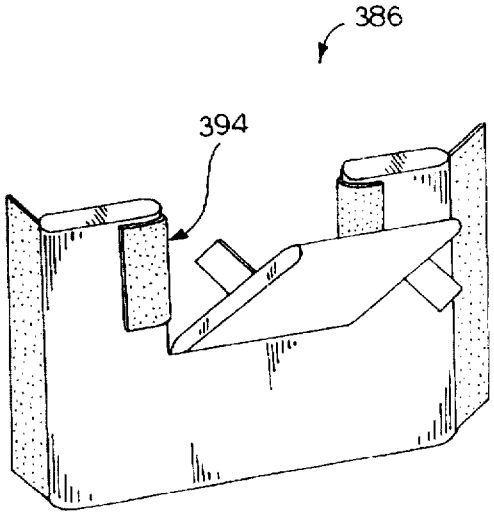
FIG. 9 is a perspective view of still another embodiment of the present invention lens-gate divider.

As with the vertically oriented swinging gates, the horizontally hingeably attached swinging gates can be incorporated into any other shape cutout design. This embodiment utilized with a square shaped cutout design is illustrated in FIG. 9. Referring to FIG. 9, there is shown a perspective view of this embodiment of the present invention lens-gate divider system. In this embodiment, the lens-gate divider 386 assembles and functions the same as previously described in FIGS. 7 and 8 except that the cutout portion is a square shaped cutout portion 394, and therefore the description thereof will not be repeated.

Referring to FIG. 10, there is shown a perspective view of another embodiment of the present invention lens-gate divider system. In this embodiment, the lens-gate divider 488 has a central opening 490. A swinging gate 492 is hingeably attached to a side of the lens-gate divider 488 and located adjacent a top end 494 and covers the central opening 490. The swinging gate 492 can swing in the vertical direction to open or close the central opening 490.

Referring to FIG. 11, there is shown a cross-sectional view of the embodiment shown in FIG. 10. The gate 492 can be held in the opening 490 by a press fit. For additional closure power, in this embodiment, there are means for maintaining the swinging gate 492 in the closed position by Velcro® fastener tabs 496.

Therefore, the overall concept of the preferred embodiment of the present invention, which as illustrated and described can be incorporated into many different designs and configurations, is to have at least one divider within the camera bag which divider can be affixed by adjustment means such as matching hook and loop fasteners, to be positioned at any desired location within the camera bag. The at least one divider has a cutout portion, which in the preferred embodiment is centrally located on the divider but can be at an offset location if desired. The preferred configuration of the divider is a U-shaped configuration but any other shaped cutout is also within the spirit and scope of the present invention. The divider has at least one conforming shape hingeably attached gate or door which conforms to the shape of the cutout and can swing in the vertical direction or horizontal direction to close the divider so that it is a fully closed barrier or to open the divider so items such as a camera lens can be inserted through the cutout portion, with the opened gates providing a cushioning means or barrier to protect the lens from adjacent objects.

While the preferred embodiment of the present invention involves the incorporation of the lens-gate into a divider having a cutout so that the gate serves to open or close the cutout to thereby permit an object such as a lens to be inserted through the cutout and protected by the gate, it is also within the spirit and scope of the present invention to include the swinging gate as a self-contained unit which can compartmentalize the camera bag into a multiplicity of different compartments. This concept is illustrated in FIGS. 11 through 15.

Figure 12:
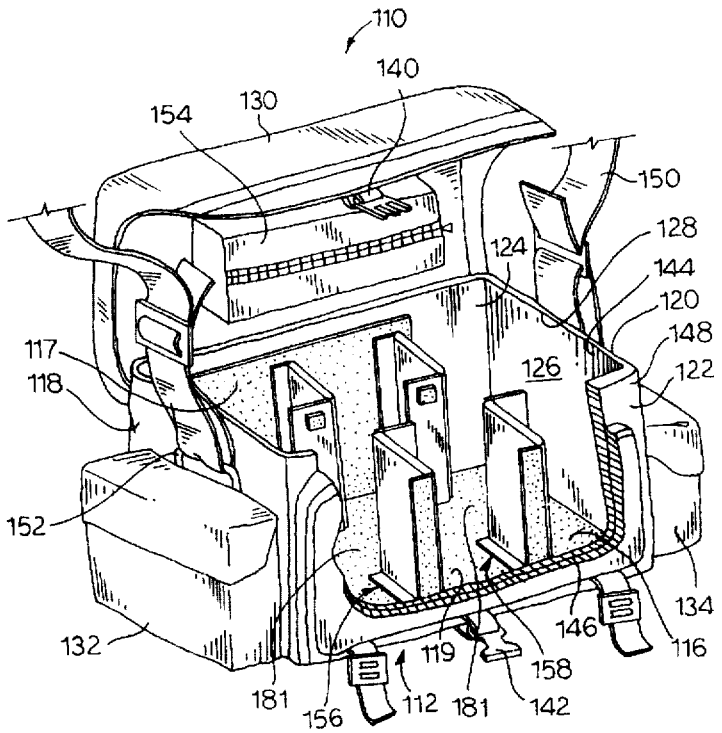
FIG. 12 is a partial cutout perspective view of the camera bag, illustrating still another embodiment of the lens-gate divider system.

FIG. 12 shows a perspective view of this alternative embodiment of the present invention lens-gate divider 156.

Figure 13:
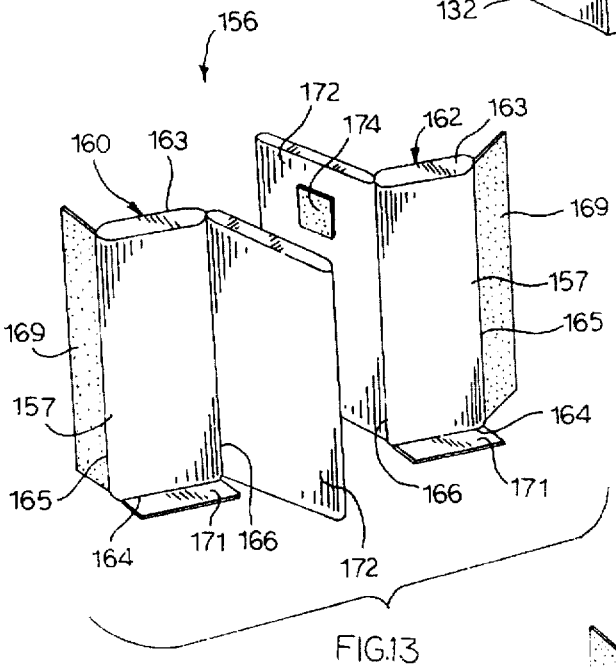
FIG. 13 is a perspective view of one of the lens-gate dividers which is shown in FIG. 12.

Referring to FIGS. 12 and 13, the lens-gate divider system 112 includes at least one generally vertical and parallel lens-gate divider. Two such dividers 156 and 158 are illustrated. The system may also include at least one generally horizontal divider 55 (shown in FIGS. 2 and 7) extending between the end walls and the two vertical dividers 156 and 158 for organizing and confining the photographic equipment below the protruding lens of the camera body.

It will be appreciated that the lens-gate divider system 112 is not limited to two vertical upright lens-gate dividers as illustrated in FIG. 12. It is emphasized that while the two vertical lens-gate dividers 156 and 158 shown in FIG. 2 are adequate for this type of arrangement, it is also within the spirit and scope of the present invention to have a multiplicity of vertical upright lens-gate dividers or at least one vertical upright lens-gate divider.

The lens-gate dividers 156 and 158 extend the entire distance between the sidewalls 122 and 124 of the enclosure 126 and are adjustably secured to the sidewalls. The dividers 156 and 158 are spaced from the end walls 118 and 120 of the enclosure 126 for dividing the camera bag 110 into at least three compartments. The number of compartments will change depending on the number of dividers used.

The lens-gate dividers 156 and 158 are preferably identical in construction, and only one will be described in detail. The lens-gate divider 156 comprises a vertical upright left panel 160 and a vertical upright right panel 162, and because the vertical panels 160 and 162 are preferably identical in construction, only one will be described in detail.

The vertical panel 160 is formed of a sandwich of an outer layer 157 covering a central foam plastic panel (shown in FIG. 4). Normally, the outer layer 157 is formed as a pocket, the foam panel is inserted into an opening left in the pocket, and then the opening is closed by sewing the last seam. The outer layer 157 is the same material used for the inner layer 144 of the camera bag for the same reasons the material is used in those applications, and the foam panel is also the same that is used in the end walls, the sidewalls and the bottom wall of the camera bag.

The vertical panel 160 has a top edge 163, a bottom edge 164 and two vertical edges 165 and 166. These vertical panels 160 and 162 are protecting camera lenses or other components such as battery packs, filters, light meters, etc. from horizontal movement within the camera bag. Each vertical panel has a lateral swinging gate or door 172 which is of the same height as the vertical panel, but smaller in width than the vertical panel. The swinging gate 172 is hingeably attached to the vertical edge 166, such that the swinging gate 172 is moveable between an open position and a closed position. As with the embodiments previously described, the hingeable attachment means can be any means such as sewing, mating hook and loop fasteners and snaps. The hinge means can be a stitched line between the panels which permits one panel to move or swing relative to the other panel. The gates can remain in the closed position by friction. Alternatively, the swinging gates 172 may also include means for maintaining them in the closed position. The means are Velcro® fastener tabs 174 which are attached to sides of the swinging gates 172 by conventional means, and are facing each other. When the swinging gates 172 are in the closed position, the lens-gate divider 156 assembles into a full length divider. The swinging gates 172 are formed in the same manner as the lens-gate divider 156, and the description thereof will not be repeated.

The two vertical panels 160 and 162 are secured to the sidewalls 122 and 124 by adjustable securing means and leave a gap portion 181 uncovered which is the entrance to the different compartments. An elongated strip 169 is attached by an attachment means such as sewing along the seam of the longitudinal edge 165 of the vertical panel 160. The elongated strip 169 has a Velcro® surface consisting of the hook portion, although a wide variety of holding means may be provided. Another Velcro® strip 171 is attached by attachment means on the transverse bottom edge 164 and extends in the width direction of the vertical panel. The Velcro® surface of the strip 171 can either be the hook or loop type, depending on the situation. The same is true for panel 162.

Two elongated wide opposite strips 117 (only one is shown in FIG. 11) extend along generally the entire length of the sidewalls 122 and 124 of the camera bag 110. These wide strips 117 have the complimentary Velcro® loop pile that is gripped by the Velcro® hooks on the vertical strips 169. By positioning the vertical strips 169 along the corresponding wide strips 117, the positions of the dividers can be changed, and the size of the compartment is modified. The wide strips 117 may be attached by adhesives to the interior sidewalls of the camera bag 110, but is preferably sewn on. Another wide strip 119 is attached to the base 116 of the camera bag 110 and has complimentary Velcro® loop or hook pile that is gripped by the Velcro® strip 171 on the vertical panel 160 for stabilizing the vertical panels 160 in the upright direction.

The present invention conforms to conventional forms of manufacture and is easy to use so it provides a device that will be economically feasible, long lasting and relatively trouble-free in operation. The sewing of the components is accomplished by any conventional means known to one skilled in the art.

The next embodiment of the present invention is very similar to the previously described embodiment just discussed and the only difference is the nature and configuration of the swinging gates 272 on the first and second pairs of vertical upright panels 260. All of the parts of this embodiment lens-gate divider system 212 are numbered correspondingly with 200 added to each number.

Figure 14:
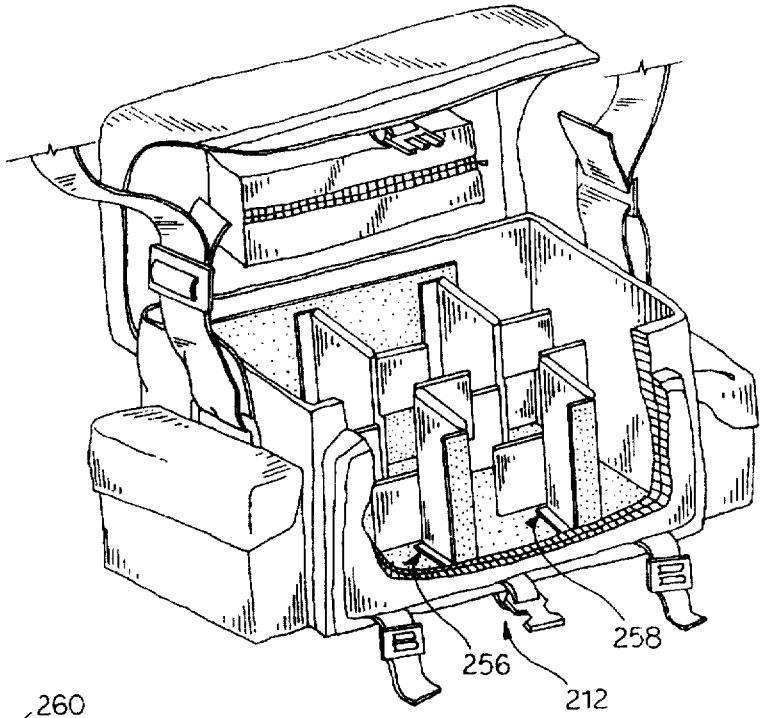
FIG. 14 is a partial cutout perspective view of the camera bag, illustrating another embodiment the present invention lens-gate divider system.
Figure 15:
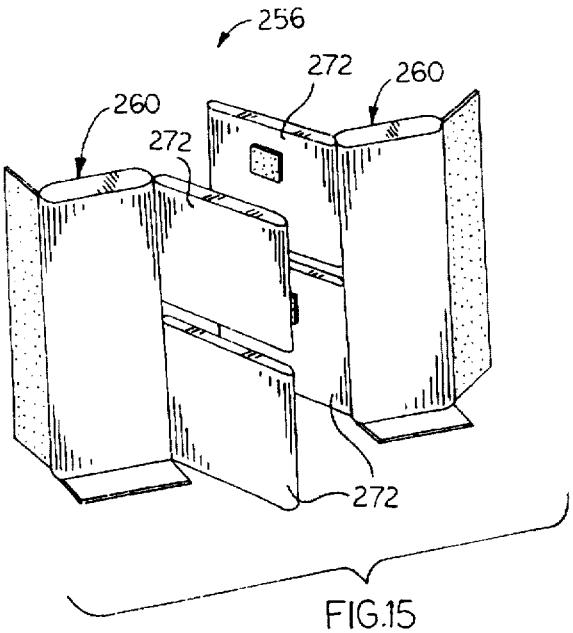
FIG. 15 is a perspective view of one of the lens-gate dividers which is shown in FIG. 14.

Referring to FIGS. 14 and 15, there is shown this embodiment of the present invention lens-gate divider system 212 which comprises two spaced apart generally vertical and parallel lens-gate dividers 256 and 258. In this embodiment, there are illustrated at least two lateral swinging gates 272 on each vertical panel 260. The at least two lateral swinging gates 272 on each vertical panel 260 function in the same manner previously discussed, and the description thereof will not be repeated.

Employing this concept, the system may also include horizontal dividers 55 as illustrated in FIG. 2 which swing in the vertical direction to divide the camera bag into upper and lower compartments.

The claims of invention in this divisional patent application are directed to FIGS. 14 and 15.

Defined in detail, the present invention is a camera bag for holding photographic equipment such as a camera which has a body and a protruding lens attached thereto and extending laterally from the body, the camera bag comprising: (a) a generally rectangular base wall and a pair of end walls connected at their ends to a pair of sidewalls, the walls extending upwardly from the base wall to form an enclosure with a top opening; (b) a cover secured to said enclosure and adapted to be positioned to span and enclose said top opening of said enclosure for restraining and protecting said photographic equipment; (c) at least one vertical divider attachable to and extending between said sidewalls of said enclosure and spaced from said end walls of said enclosure, the divider having a top end and a bottom end, the top end of the divider having a U-shaped cutout portion for closely receiving and supporting said protruding lens while said protruding lens is attached to said camera body, the U-shaped cutout portion having two inner opposite vertical edges and an inner curved edge merging with the two inner vertical edges to form a continuous edge; (d) said cutout portion being spaced vertically above said base wall of said camera bag far enough to permit storage of said photographic equipment below said cutout portion; and (e) a pair of swinging gates for covering said U-shaped cutout portion of said at least one vertical divider, one of the pair of swinging gates hingeably attached to one of said two vertical edges of said U-shaped cutout portion, and the other one of the pair of swinging gates hingeably attached to the opposite one of said two vertical edges of said U-shaped cutout portion, where the pair of swinging gates can be swung open to allow said protruding lens being placed within said U-shaped portion of said first vertical divider and further protect said protruding lens from two lateral sides and further prevent said protruding lens from lateral movement, and the pair of swinging gates can be swung closed when there is no lens being placed within said U-shaped cutout portion and transform said at least one vertical divider into a full length divider without opening.

Defined broadly, the present invention is a camera bag for holding photographic equipment such as a camera which has a body and a protruding lens attached thereto and extending laterally from the body, the camera bag comprising: (a) a base and sidewalls, the sidewalls extending upwardly from the base to form an enclosure; (b) at least one vertical divider attachable to and extending between a respective two of said sidewalls of said enclosure and having a top end and a bottom end, the top end having a cutout portion for closely receiving and supporting said protruding lens while said protruding lens is attached to said camera body, the cutout portion having two vertical edges; and, (c) at least one swinging gate for covering said cutout portion of said at least one vertical divider and hingeably attached to one of said two vertical edges of said cutout portion, where the at least one swinging gate can be swung open to allow said protruding lens being placed within said cutout portion of said at least one vertical divider and further protect said protruding lens from at least one lateral side and further prevent said protruding lens from lateral movement, and the at least one swinging gate can be swung closed when there is no lens being placed within said cutout portion.

Defined more broadly, the present invention is a camera bag for holding photographic equipment such as a camera which has a body and a protruding lens attached thereto and extending laterally from the body, the camera bag comprising: (a) a base and sidewalls connected at their ends and extending upwardly from the base to form an enclosure; (b) at least one divider attachable to and extending between opposite sidewalls of said enclosure and having a first end and a second end, the at least one divider having a cutout opening with at least one edge for closely receiving and supporting said protruding lens while said protruding lens is attached to said camera body; and (c) at least one swinging door hingeably attached adjacent to the at least one edge of said cutout opening; (d) whereby when said protruding lens of said camera body is received and supported in said cutout opening, said at least one swinging door is in an opened position, and when said protruding lens is not attached to said camera body, said at least one swinging door can be positioned in a closed position.

Defined even more broadly, the present invention is a lens-gate divider system for a camera bag to hold photographic equipment such as a camera which has a body and a protruding lens attached thereto and extending laterally from the body, the camera bag has a base and sidewalls, the sidewalls extending upwardly from the base to form an enclosure, the divider system comprising: (a) at least one vertical divider attachable to and extending between opposite sidewalls of said enclosure and having a top end and a bottom end, the top end having a cutout portion for closely receiving and supporting said protruding lens while said protruding lens is attached to said camera body; (b) said at least one vertical divider having two lateral supports located adjacent to said top end and beside said cutout portion for preventing said protruding lens of said camera body from a lateral movement; and (c) at least one swinging gate for covering said cutout portion of said at least one vertical divider and hingeably attached to an edge of said cutout portion, where the at least one swinging gate can be swung open to allow said protruding lens being placed within said cutout portion of said at least one vertical divider and further protect said protruding lens from at least one lateral side and further prevent said protruding lens from lateral movement, and the at least one swinging gate can be swung closed when there is no lens being placed within said cutout portion.

Defined further more broadly, the present invention is a divider system for a case, the system comprising: (a) at least one divider attachable within and extending within said case, the at least one divider having a cutout opening with at least one edge; and (b) at least one swinging door hingeably attached to said divider adjacent to said at least one edge of said opening; (c) whereby when one object is received and supported in said cutout opening, said at least one swinging door is in an opened position, and when said object is not in said cutout opening, said at least one swinging door can be positioned in a closed position.

Defined alternatively in detail, the present invention is a camera bag for holding photographic equipment, comprising: (a) a generally rectangular base wall and a pair of end walls connected at their ends to a pair of sidewalls, the walls extending upwardly from the base wall to form an enclosure with a top opening; (b) a cover secured to said enclosure and adapted to be positioned to span and enclose said top opening of said enclosure for restraining and protecting said photographic equipment; (C) at least one pair of spaced apart vertical panels attachable to and extending between said sidewalls of said enclosure and leaving a gap portion between the pair of vertical panels and spaced from one of said end walls of said enclosure, each of the at least one pair of panels having a bottom edge, two vertical side edges and a top edge; (d) means for stabilizing said at least one pair of vertical panels within said enclosure; and (e) a pair of swinging gates extending between said at least one pair of vertical panels and covering said gap portion in said enclosure, one of the pair of swinging gates hingeably attached to a proximal one of said two vertical side edges of the at least one pair of panels, and the other one of the pair of swinging gates hingeably attached to a proximal one of said two vertical side edges of the other one of said at least one pair of panels, where the at least one pair of swinging gates can swing open or closed and transform said at least one pair of panels into a full length divider.

Defined alternatively broadly, the present invention is a camera bag for holding photographic equipment, comprising: (a) a generally rectangular base wall and a pair of end walls connected at their ends to a pair of sidewalls, the walls extending upwardly from the base wall to form an enclosure with a top opening; (b) a cover secured to said enclosure and adapted to be positioned to span and enclose said top opening of said enclosure for restraining and protecting said photographic equipment; (c) at least one pair of spaced apart vertical panels attachable to and extending between said sidewalls of said enclosure and leaving a gap portion between the at least one pair of vertical panels, and spaced from one of said end walls of said enclosure, each of the pair of panels having a bottom edge, two vertical side edges and a top edge; (d) means for stabilizing said at least one pair of vertical panels within said enclosure; and (e) two pairs of swinging gates extending between said at least one pair of vertical panels and covering said gap portion in said enclosure, two of the two pairs of swinging gates stacked and hingeably attached to a proximal one of said two vertical side edges of said at least one pair of vertical panels, and the other two of the two pairs of swinging gates stacked and hingeably attached to a proximal one of said two vertical side edges of the other one of said at least one pair of vertical panels, where the two pairs of swinging gates can be swung open or closed to transform said at least one pair of vertical panels into a full length divider.

Defined alternatively more broadly, the present invention is a camera bag for holding photographic equipment, comprising: (a) a base and sidewalls extending upwardly from the base to form an enclosure; (b) at least two panels attachable to and extending between opposite sidewalls of said enclosure and leaving a gap portion between the at least two panels, each panel having a bottom edge and two side edges; and (c) at least one swinging door hingeably attached to a proximal one of said two side edges of one of said at least two panels for covering said gap portion in said enclosure.

Defined alternatively even more broadly, the present invention is a lens-gate divider system for a case which has a base wall, and a pair of sidewalls, the system comprising: (a) at least one vertical panel attachable to and extending between said sidewalls and leaving a gap portion between the at least one pair of vertical panels, the pair of vertical panels having a bottom edge, two vertical side edges and a top edge; (b) means for stabilizing said pair of vertical panels; and (c) a pair of swinging gates extending between said at least one pair of vertical panels and covering said gap portion in said enclosure, one of the pair of swinging gates hingeably attached to a proximal one of said two vertical side edges of one of said pair of panels, and the other one of the pair of swinging gates hingeably attached to a proximal one of said two vertical side edges of the respective other one of said pair of panels, where the pair of swinging gates can swing open or closed and transform said pair of panels into a full length dividers.

Defined additionally alternatively more broadly, the present invention is a lens-gate divider system for a case which has a base wall, and a pair of sidewalls, the system comprising: (a) at least one pair of spaced apart vertical panels attachable to and extending between said sidewalls and leaving a gap portion between the at least one pair of vertical panels, each of the at least one pair of panels having a bottom edge, two vertical side edges and a top edge; (b) means for stabilizing said at least one pair of vertical panels; (c) two pairs of swinging gates extending between said at least one pair of vertical panels and covering said gap portion in said enclosure, two of the two pairs of swinging gates stacked and hingeably attached to a proximal one of said two vertical side edges of one of said at least one pair of vertical panels, and the other two of the two pairs of swinging gates stacked and hingeably attached to a proximal one of said two vertical side edges of the other one of said at least one pair of vertical panels, where the two pairs of swinging gates can be swing open or closed to transform said first pair of vertical panels into a full length divider.

Defined further alternatively more broadley, the present invention is a divider system for a case with interior walls, comprising: (a) at least two vertical walls attachable to and extending between said interior walls of said case and leaving a gap portion between the at least two vertical walls, each vertical wall having a bottom edge and two side edges; and (b) at least one swinging door hingeably attached to a proximal one of said two side edges of one of said at least two vertical walls for covering said gap portion.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A camera bag for holding photographic equipment, comprising:

a. a generally rectangular base wall and a pair of end walls connected at their ends to a pair of sidewalls, the walls extending upwardly from the base wall to form an enclosure with a top opening;

b. a cover secured to said enclosure and adapted to be positioned to span and enclose said top opening of said enclosure for restraining and protecting said photographic equipment;

c. at least one pair of spaced apart vertical panels attachable to and extending between said sidewalls of said enclosure and leaving a gap portion between the at least one pair of vertical panels, and spaced from one of said end walls of said enclosure, each of the pair of panels having a bottom edge, two vertical side edges and a top edge;

d. means for stabilizing said at least one pair of vertical panels within said enclosure; and e. two pairs of swinging gates extending between said at least one pair of vertical panels and covering said gap portion in said enclosure, two of the two pairs of swinging gates stacked and hingeably attached to a proximal one of said two vertical side edges of said at least one pair of vertical panels, and the other two of the two pairs of swinging gates stacked and hingeably attached to a proximal one of said two vertical side edges of the other one of said at least one pair of vertical panels, where the two pairs of swinging gates can be swung open or closed to transform said at least one pair of vertical panels into a full length divider.

2. The invention as defined in claim 1 further comprising means for maintaining said two pairs of swinging gate in the closed position.

3. The camera bag in accordance with claim 2 wherein said means for maintaining said two pairs of swinging gates in the closed position comprises at least four male fasteners and at least four female fasteners with complementary mating surfaces, where four of the male and female fasteners are attached to opposite adjacent respective surfaces of said two pairs of swinging gates.

4. The camera bag in accordance with claim 1 wherein said means for stabilizing said at least one pair of vertical panels from moving within said enclosure includes fastener strips hingeably attached to said transverse bottom edges of said first and second pairs of vertical panels respectively.

5. A lens-gate divider system for a case which has a base wall, and a pair of sidewalls, the system comprising:

a. at least one pair of spaced apart vertical panels attachable to and extending between said sidewalls and leaving a gap portion between the at least one pair of vertical panels, each of the at least one pair of panels having a bottom edge, two vertical side edges and a top edge;

b. means for stabilizing said at least one pair of vertical panels;

c. two pairs of swinging gates extending between said at least one pair of vertical panels and covering said gap portion in said enclosure, two of the two pairs of swinging gates stacked and hingeably attached to a proximal one of said two vertical side edges of one of said at least one pair of vertical panels, and the other two of the two pairs of swinging gates stacked and hingeably attached to a proximal one of said two vertical side edges of the other one of said at least one pair of vertical panels, where the two pairs of swinging gates can be swing open or closed to transform said first pair of vertical panels into a full length divider.

6. The lens-gate divider system in accordance with claim 5 further comprising means for maintaining said two pairs of swinging gates in the closed position.

7. The lens-gate divider system in accordance with claim 5 wherein said means for stabilizing said at least one pair of vertical panels from moving within said enclosure includes fastener strips hingeably attached to said transverse bottom edges of said at least one pair of vertical panels.

* * * * *